US006464323B2

(12) United States Patent
Yokoyama et al.

(10) Patent No.: US 6,464,323 B2
(45) Date of Patent: Oct. 15, 2002

(54) REGISTRATION ADJUSTING METHOD OF INK-JET PRINTING APPARATUS

(75) Inventors: Daisuke Yokoyama, Tama; Yasuyuki Takanaka, Yokohama, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/840,233

(22) Filed: Apr. 24, 2001

(65) Prior Publication Data

US 2002/0003552 A1 Jan. 10, 2002

(30) Foreign Application Priority Data

Apr. 27, 2000 (JP) ..... 2000-128482

(51) Int. Cl.[7] ..... B41J 29/393; B41J 29/38
(52) U.S. Cl. ..... 347/19; 347/14
(58) Field of Search ..... 347/19, 43, 42, 347/41, 47, 14, 23, 15, 10, 12; 400/74

(56) References Cited

U.S. PATENT DOCUMENTS 4,313,124 A 1/1982 Hara
4,345,262 A 8/1982 Shirato et al.
4,459,600 A 7/1984 Sato et al.
4,463,359 A 7/1984 Ayata et al.
4,558,333 A 12/1985 Sugitani et al.
4,608,577 A 8/1986 Hori
4,723,129 A 2/1988 Endo et al.
4,740,796 A 4/1988 Endo et al.
4,956,648 A * 9/1990 Hongo ..... 347/19

FOREIGN PATENT DOCUMENTS

JP 54-56847 5/1979
JP 59-123670 7/1984
JP 59-138461 8/1984
JP 60-71260 4/1985

* cited by examiner

*Primary Examiner*—John Barlow
*Assistant Examiner*—Charles W. Stewart, Jr.
(74) *Attorney, Agent, or Firm*—Fitzpatrick, Cella, Harper & Scinto

(57) ABSTRACT

A registration adjusting is performed for reducing an error in registration adjustment due to tolerance in manufacturing of a linear encoder scale. In the method, a printing head located at a position closest to a center position among a plurality of printing heads arranged along a primary scanning direction is taken as a reference printing head for registration adjustment.

10 Claims, 8 Drawing Sheets

REGISTRATION ADJUSTING METHOD OF INK-JET PRINTING APPARATUS

This application is based on patent application Ser. No. 2000-128482 filed Apr. 27, 2000 in Japan, the content of which is incorporated hereinto by reference.

BACKGROUND OF THE INVENTION

1. Field of the Invention

The present invention relates to a registration adjusting method for correcting a mounting error of printing heads by controlling a printing timing between a plurality of printing heads in an ink-jet printing apparatus performing printing on a printing medium using the printing heads.

2. Description of the Related Art

In a serial type printing apparatus employing a serial scanning system taking a direction substantially perpendicular to a feeding direction of a printing medium (auxiliary scanning direction) as a primary scanning direction, printing for the entire printing medium is performed by repeating operations of printing (primary scan) an image by printing heads mounted on a carriage moving along the printing medium, after printing for one line, performing paper feeding for a predetermined amount, and subsequently performing printing (primary scan) again for the next line for the printing medium.

In such ink-jet type color printer of the type performing serial printing, a plurality of printing heads respectively ejecting inks of yellow, magenta, cyan and black are mounted on the carriage. Upon primary scan, respective colors of inks are ejected from respective of a plurality of printing heads at predetermined timing to perform image printing.

Upon performing color printing with the construction set forth above, images of respective colors formed by a plurality of printing heads have to be accurately overlaid per each pixel in order to maintain good image quality. For this purpose, it is required to accurately adjust positional relationship of a plurality of printing heads.

However, upon exchanging the printing head and so on, if the positional relationship of a plurality of printing heads on the carriage is displaced, desired printing quality cannot be obtained. In order to solve this problem, the following registration adjustment is performed.

Namely, using a plurality of printing heads, a registration error detecting chart pattern is printed. The result of printing is read by a sensor or the like to detect offset amounts of depositing positions between respective printing heads on the basis of the result of reading. Upon printing, on the basis of the detected offset amount, ejection timing of each printing head is adjusted to have dots of respective colors overlaid at the same position.

However, in the printing apparatus, in which a plurality of printing heads are aligned in the scanning direction, it is difficult to appropriately perform registration.

SUMMARY OF THE INVENTION

The present invention has been developed in view of the shortcoming set forth above. Therefore, it is an object of the present invention to reduce registration adjustment due to tolerance in manufacturing of a linear encoder scale, thereby improving image quality.

It is another object of the present invention to provide a registration adjusting method of an ink-jet printing head which can effectively perform the process upon exchanging a reference head.

In the first aspect of the present invention, there is provided a registration adjusting method for an ink-jet printing apparatus, in which one of a plurality of printing heads arranged along a primary scanning direction is taken as a reference printing head, a relative positional relationship between an ink droplet ejected on a printing medium from the reference printing head and an ink droplet ejected on the printing medium from a non-reference printing head is measured by converting number of encoder pulse signals, and registration adjustment for nonreference printing head is performed by correcting an ink ejection timing of the non-reference printing head relative to the reference printing head with the encoder pulse signals on the basis of a result of measurement, wherein a printing head located close to a center position among the plurality of printing heads is taken as the reference printing head for registration adjustment.

With the present invention as set forth above, the printing head located at a position closest to the center position among a plurality of printing heads is taken as a reference for registration adjustment. Therefore, distances between respective non-reference printing heads and the reference printing head can be equalized so that a non-reference printing head having a particularly large distance from the reference printing head in comparison with other non-reference printing heads can be eliminated. Accordingly, an error in registration adjustment due to tolerance in manufacturing of the linear encoder scale can be reduced.

In the second aspect of the present invention, there is provided a registration adjusting method for an ink-jet printing apparatus, in which one of a plurality of printing heads arranged along a primary scanning direction is taken as a reference printing head, a relative positional relationship between an ink droplet ejected on a printing medium from the reference printing head and an ink droplet ejected on the printing medium from a non-reference printing head is measured by converting the number of encoder pulse signals, and registration adjustment for the non-reference printing head is performed by correcting an ink ejection timing of the non-reference printing head relative to the reference printing head with the encoder pulse signals on the basis of a result of measurement, wherein, upon exchanging the reference printing head, the method comprises the steps of:

exchanging the reference printing head on a carriage;

ejecting ink on the printing medium from the reference printing head in a condition where the carriage is scanned to a predetermined first position;

ejecting ink on the printing medium from a predetermined non-reference printing head in a condition where the carriage is scanned to a second position from the predetermined first position for a distance corresponding to a distance between the reference printing head and the predetermined non-reference printing head;

measuring a depositing position error between two strings of ink ejected on the printing medium; and correcting the ejection timing of the reference printing head on the basis of the measured depositing position error so that the two strings of ink match in the primary scanning direction.

With this invention, when the reference printing head is exchanged, the registration adjustment of the reference head is performed using registration adjustment amount data of the non-reference printing head and the exchanged reference head to make registration adjustment upon exchanging of the reference printing head efficient and whereby a period for registration adjustment is shortened.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Before detailed description of embodiments of the present invention with reference to the drawings, explanation will be given for preliminary study made by the inventors.

Here, upon adjustment of registration, among a plurality of printing heads aligned in a primary scanning direction, a printing head located at an end of a carriage is taken as a reference head. With respect to the reference head, offset amounts of other printing heads are detected for adjusting ink ejection timing of respective printing heads on the basis of the detected offset amounts.

Then, upon adjusting the ejection timing of a respective printing head, an encoder pulse signal output from a linear encoder provided along a moving direction of the carriage is used. On the other hand, the ink ejection timing of the printing head other than the reference head is determined with reference to the reference head. Namely, a timing of occurrence of the (n)th encoder pulse signal from the timing of driving of the reference head is taken as the ink ejection timing of the printing head other than the reference head. The number of the encoder pulse n, namely, a moving amount of the carriage, is determined respectively on the basis of the detected offset amount of each printing head.

Registration adjustment according to preliminary study set forth above will be explained in detail with reference to FIG. 8.

Figure 8:
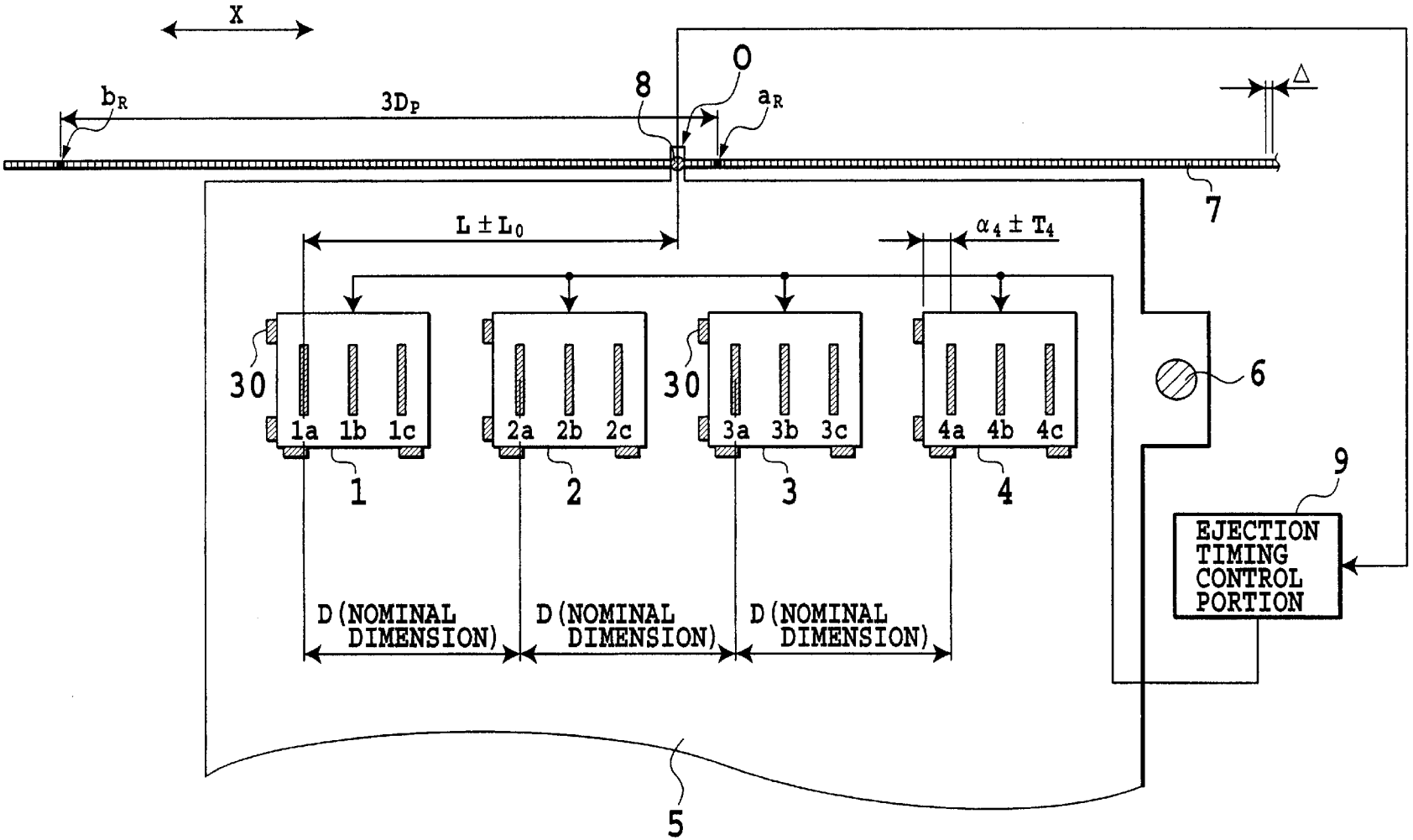
FIG. 8 is an illustration for explanation of a preliminary registration adjusting method according to the present invention.

In FIG. 8, four printing heads 1 to 4 are mounted on a carriage 5. In respective heads 1 to 4, three chips 1*a* to 1*c*, . . . , 4*a* to 4*c* are provided. Along moving directions X of the carriage 5, a linear encoder scale 7 is arranged. On a side of the carriage 5, an encoder sensor 8 for detecting a scale of the linear encoder scale 7 is arranged. On the other hand, on the carriage 5, a registration sensor 6 for detecting offset of deposition of ink droplet is provided.

As set forth above, in the preliminary study, the printing head 1 located at the end portion of the carriage 5 among the four printing heads 1 to 4 is taken as the reference head.

Here, it is assumed that a printing head 4 is exchanged or replaced by printing head 4'.

At first, the printing head 4 before exchanging is removed from the carriage 5 and the printing head 4' after exchanging is mounted at the predetermined position.

Next, the carriage 5 is moved. Thereafter, when the encoder sensor 8 (point O) reaches a predetermined point $a_R$ on the linear encoder 7, ink is ejected from a chip 1*a* of the reference head 1. Here, upon ejecting the ink, the ink ejection timing is adjusted according to an adjusting value stored in a conversion table of an ejection timing control portion 9 for performing ejection at a true position $a_R$ not containing tolerance in manufacturing of the linear encoder scale 7. Namely, in the conversion table, in connection with the point $a_R$, a value corresponding to an error between a point $a_R'$ actually indicated by the linear encoder scale 7 (containing tolerance in manufacturing) and the true point $a_R$ is stored.

Next, according to the encoder pulse signal obtained from the linear encoder scale 7, the carriage 5 is moved in X direction for three nominal dimension 3×D corresponding to a distance between a chip 1*a* of the reference head 1 and a chip 4*a'* of the head 4' exchanged. Thereafter, ink is ejected from the chip 4*a'*.

Here, assuming that a point where the encoder sensor 8 is positioned after moving the carriage is $b_R$, ejection of ink can be performed at a true position $b_R$ not containing error in tolerance in manufacturing of the linear encoder scale 7 by adjusting the ejection timing of the ink using a conversion table similar to the above. Namely, in the conversion table, concerning this point $b_R$, a value corresponding to an error between the point $b_R'$ which is actually indicated by the linear encoder scale 7 (containing tolerance in manufacturing) and the true position $b_R$ is stored.

Here, accuracy of a dimension from the chip 1*a* to 4*a* of respective printing heads 1 to 4 to the positioning member 30 of respective printing heads 1 to 4, namely, a mounting error of respective printing heads 1 to 4, is expressed by Ti (=about ±100 μm, i=1 to 4). As set forth above, a mounting error of each printing head is about ±100 μm. In view of dot accuracy required for ink droplets for forming an image, the mounting error cannot be ignored.

On the other hand, assuming a tolerance (including a mounting error of the reference head 1) of the encoder sensor 8 and the reference head 1 in the primary scanning direction is $L_0$, a depositing position of the ink droplet ejected from the reference head 1 may have offset of $\pm L_0$ from the true position, and the depositing position of the ink droplet ejected from the head 4' may have offset of $\pm L_0$+Ti from the true position. Accordingly, the relative depositing position error between the ink droplet ejected from the chip la and the ink droplet ejected from the chip 4*a'* becomes ±T4.

Accordingly, the depositing position error ±Ti (i=4 in this case) of the printing dot ejected at the point aR and the printing dot ejected at the point $b_R$ is read out by the registration sensor 6 for converting the depositing position error ±Ti into number of pulses ±δi (i=1 to 4) of the encoder pulse signal.

Therefore, upon performing printing, when the printing head 4' is driven, timing of the ejection is corrected for ±δi pulses by the ejection timing control portion 9. Thus, registration adjustment of the head 4*a'* is performed.

Concerning other printing heads 2 and 3, registration adjustment is performed in the similar manner.

Assuming that ink is ejected from respective of the printing heads 1 to 4 simultaneously when the encoder sensor 8 reaches an arbitrary point $c_R'$ on the linear encoder scale 7, depositing positions of the ink droplet ejected from the printing heads 1 to 4 are expressed as follows with taking nominal dimension between each of printing heads being D (corresponding to the number of encoder pulses Dp), a resolution of the linear encoder scale 7 being Δ, a distance between the reference chip 1*a* and the encoder sensor 8 being L, the error thereof being $L_0$, the point $c_R'$, the true position to be indicated by the point $c_R'$ being $c_R$, and an offset amount between the point $c_R'$ and the true point $c_R$ being $c_G$:

Reference Head 1; $c_R \pm c_G + L \pm L_0$

Non-reference Head 2; $c_R \pm c_G + L \pm L_0 - Dp \times \Delta$

Non-reference Head 3; $c_R \pm c_G + L \pm L_0 - 2Dp \times \Delta$

Non-reference Head 4; $c_R \pm c_G + L + L_0 - 3Dp \times \Delta$

Relative depositing positions of ink droplets of non-reference heads 2 to 4, with taking the depositing position of the ink droplet of the reference head 1 as a reference, are expressed by differences relative to the depositing position of the ink droplet of the reference head 1 as follows:

Non-reference Head 2; $-DP \times \Delta$

Non-reference Head 3; $-2Dp \times \Delta$

Non-reference Head 4; $-3Dp \times \Delta$ (1)

On the other hand, as set forth above, upon actual printing, the ink ejection timings of the non-reference printing heads 2 to 4 are determined with reference to the reference head 1. Namely, at a timing, at which the reference head 1 is driven, timings, at which predetermined number of encoder pulses as corrected using the registration adjusting values δi are output, are taken as ink ejection timing of the non-reference printing heads 2 to 4.

As set forth, in the registration adjustment, driving timings of the non-reference heads 2 to 4 are determined by counting the encoder pulse signals output from the encoder sensor 8 with reference to the driving timing of the reference head 1. Therefore, precision of adjustment in registration adjustment of respective non-reference printing heads 2 to 4 is variable depending upon distances to the non-reference printing heads 2 to 4 from the reference head 1.

Namely, since the linear encoder scale 7 contains tolerance in manufacturing, while correction can be performed using the foregoing conversion table for several predetermined points $a_R$, $b_R$ to be used for registration adjustment, it is impossible to similarly correct all points on the linear encoder scale. Accordingly, in the non-reference printing heads 2 to 4, greater distance from the reference head 1 can result in greater influence for tolerance in manufacturing of the linear encoder scale 7 upon printing. Therefore, an offset amount in depositing position of the ink droplet becomes greater at greater distance from the reference head 1.

As set forth above, by the registration adjustment as set forth above, actual image quality, namely the offset amount between respective printing heads, depends on the relative distance of respective printing heads 2 to 4 to the reference head 1, namely values expressed in the foregoing equation (1). According to the preliminary study, since the printing head 1 arranged at the end portion of the carriage 5 is set as the reference head, there is a head having a larger distance from the reference head 1 in comparison with other printing heads, such as the printing head 4 located at the other end of the carriage 5 remote from the reference head 1. This can be one of causes of degradation of the printed image quality.

On the other hand, in the preliminary study, when the reference head per se is exchanged, registration adjustment for all of other non-reference printing heads are done again, resulting in increasing operation steps and operation period to lower efficiency.

Figure 1:
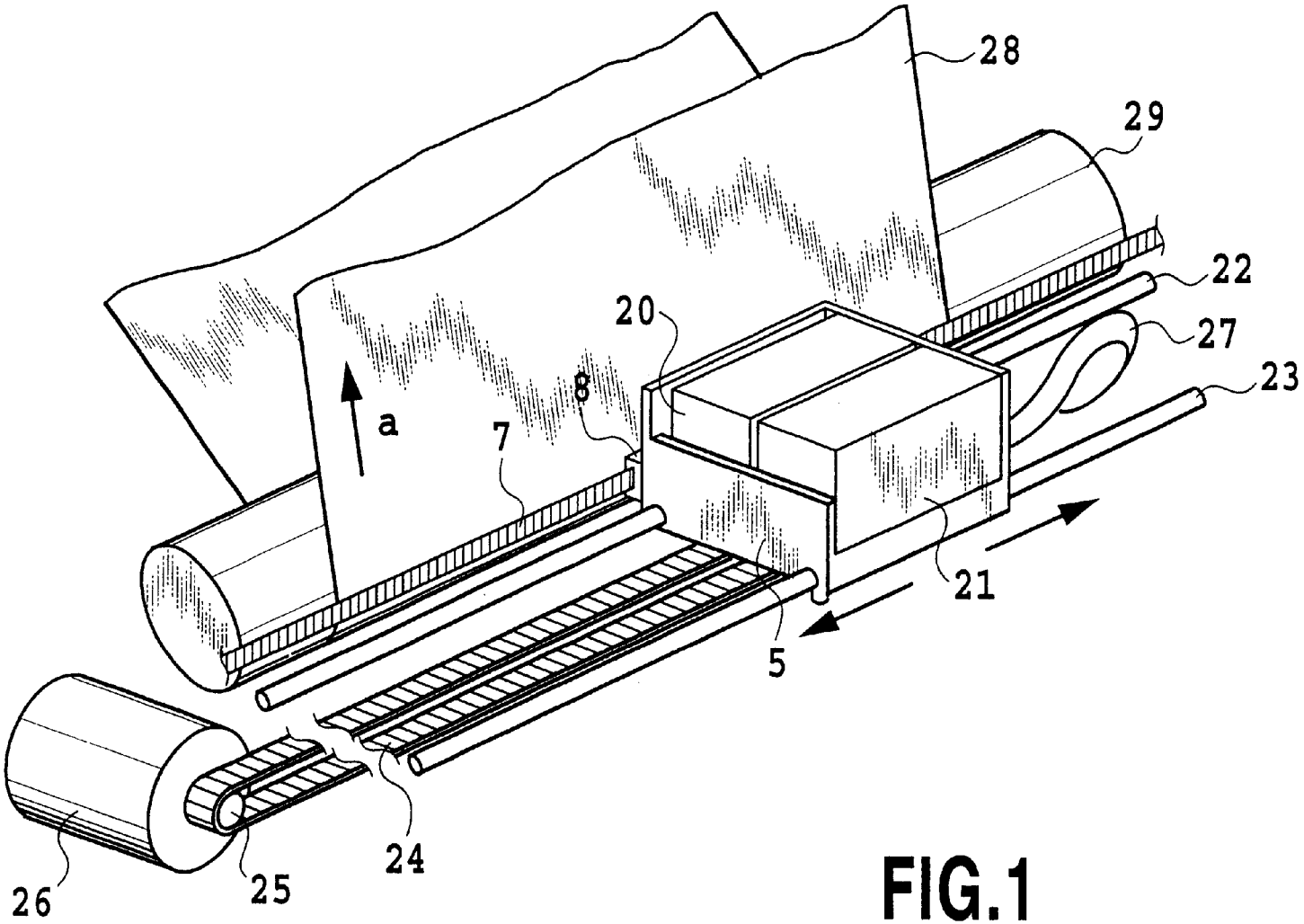
FIG. 1 is a perspective view showing an exemplification of internal structure of an ink-jet printing apparatus according to the present invention.

FIG. 1 is a perspective view showing an internal structure of a serial scanning type ink-jet printing apparatus, to which the present invention is applied.

In FIG. 1, on a carriage 5, a printing head unit 20 having a plurality of printing heads and an ink tank 21 storing a plurality of different colors of inks are mounted.

The carriage 5 is movably supported by guide shafts 22 and 23 along the carriage guide shafts 22 and 23. A part of the carriage 5 is secured to a carriage belt 24. The carriage belt 24 is stretched between a motor pulley 25 and an idler pulley (not shown). By driving of the carriage motor 26, the carriage belt 24 is moved in a forward direction and a reverse direction for scanning the carriage 5 along the carriage guide shafts 22 and 23.

On the other hand, the reference numeral 27 denotes a flexible printed cable (FPC) for transferring printing data to the printing head unit 20 and for supplying power. Reference numeral 28 denotes a sheet of printing paper to be a printing medium, and 29 denotes a feeding roller for feeding the printing paper 28 in a direction perpendicular to the scanning direction of the carriage 5 (direction of arrow a).

On the carriage 5, encoder sensor 8 is provided. By detecting a scale (slit) on the linear encoder scale 7 extending in parallel to the carriage shaft 22 by means of the encoder sensor 8, position, scanning speed and so on of the carriage can be detected. In the shown embodiment, an optical type encoder is employed. In the linear encoder scale 7, slits are formed at a predetermined pitch on a transparent film. The encoder sensor 8 is formed by a photo-interrupter or the like. By detecting the slits provided at the predetermined pitch, the encoder pulse signals corresponding to the pitch are output. It should be noted that the encoders 7 and 8 are not required to be the optical type but can be a magnetic type.

Figure 2:
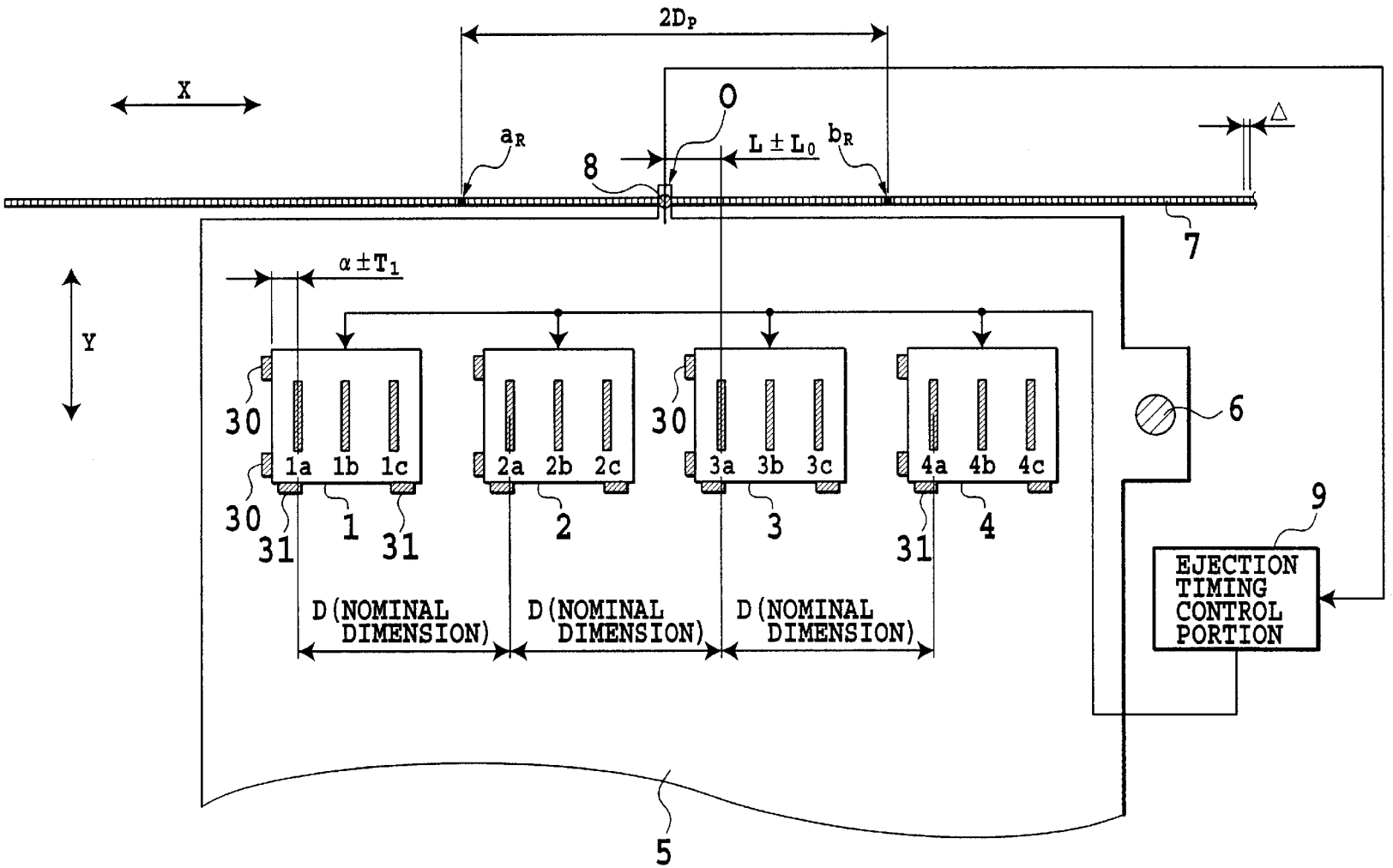
FIG. 2 is a conceptual plan view of arrangement of a plurality of the printing heads in the ink-jet printing apparatus according to the present invention.

FIG. 2 illustrates a structure of a plurality of printing heads 1 to 4 mounted on the carriage 5 and the like.

Four printing heads 1 to 4 are mounted on the carriage 5. On respective printing heads 1 to 4, three chips 1*a* to 1*c*, . . . , 4*a* to 4*c* are mounted respectively. In these chips, ink ejection elements, such as heating elements or the like are arranged in an array for ejecting ink, respectively. Corresponding to the ink ejection elements, ink ejection openings for ejecting ink are arranged in alignment. Along moving directions X of the carriage 5, the linear encoder scale 7 is arranged. At a side of the carriage 5, the encoder sensor 8 for detecting the slits of the linear encoder scale 7 is arranged. On the carriage 5, a positioning member 30 performing positioning of respective of printing heads 1 to 4 in the primary scanning direction X and a positioning member 31 performing positioning of respective printing heads 1 to 4 in the auxiliary scanning direction Y are arranged. By contacting the printing heads 1 to 4 to these positioning members 30 and 31, respective printing heads are positioned in XY direction.

On the carriage 5, a register or registration sensor 6 is further mounted. The registration sensor 6 reads a registration error detection pattern printed on the printing paper 28.

Here, in the shown embodiment, the printing head 3 (may also be the printing head 2) located at substantially center position of a plurality of printing heads 1 to 4 is taken as the reference head for registration adjustment.

Figure 3:
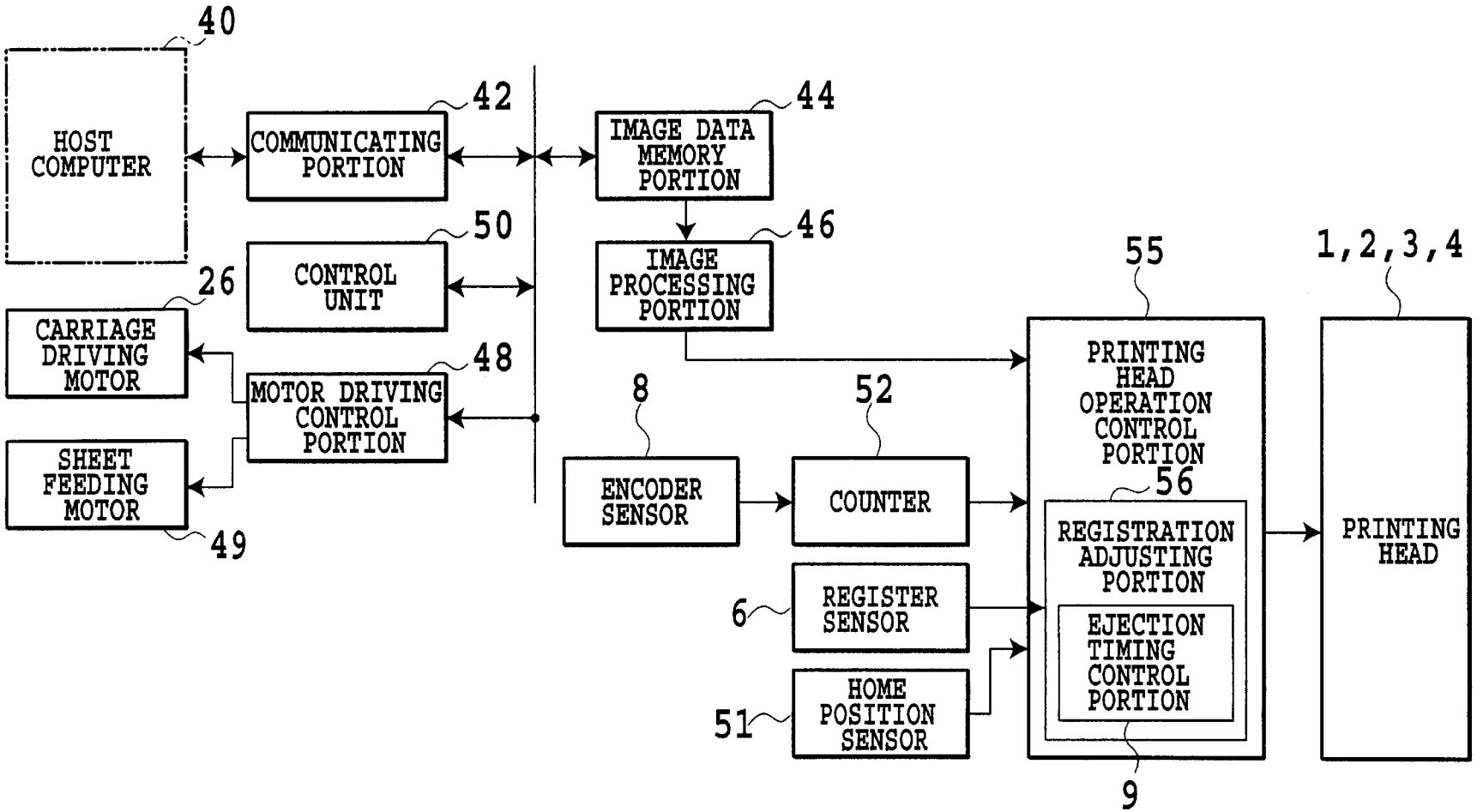
FIG. 3 is a block diagram showing an example of a construction of a control system of the ink-jet printing apparatus according to the present invention.

FIG. 3 shows an example of construction of a control system of the ink-jet printing apparatus.

A communicating portion 42 is constructed with including a predetermined interface circuit and executes transmission and reception of image data and control data with a host computer 40 connected to the ink-jet printing apparatus.

A control unit 50 unitarily controls an image data memory portion 44, an image processing portion 46 and a motor driving control portion 48. The motor driving control portion 48 forms a drive control signal for scanning the carriage 5 on the basis of the received control data to supply to the carriage motor 26. The motor driving control portion 48 also forms a feeding control signal for intermittently feeding the paper 28 depending upon printing operation of the printing portion 12 to supply to a paper feeding motor 49.

The image data memory portion 44 accumulates received image data and supplies the accumulated image data to an image processing portion 46. The image processing portion 46 provides necessary image processing for image data read out from the image data memory portion 44 for outputting a processed image signal to a printing head operation control portion 55.

A home position sensor 51 is designed to output a detection signal to the printing head operation control portion 55 when the carriage 5 is located at a predetermined stand-by position (home position). The encoder sensor 8 outputs two encoder pulse signals having phases shifted by 90°. A counter 52 detects the moving direction of the carriage depending upon advance or delay of the phase of one encoder pulse signal relative to another encoder pulse signal. Also, by counting one of the encoder pulse signals, signals indicative of moving magnitude of the carriage are output to the printing head operation control portion 55.

The registration sensor 6 detects registration error detection pattern as set forth above and outputs the detected signal to the printing head operation control portion 55.

The printing head operation control portion 55 performs driving control of the printing heads 1 to 4 and includes a registration adjusting portion 56 performing registration adjustment. The registration adjusting portion 56 includes an ejection timing control portion 9 for controlling ejection timings of the inks to be ejected from respective of the printing heads 1 to 4.

[First Embodiment]

Figure 4:
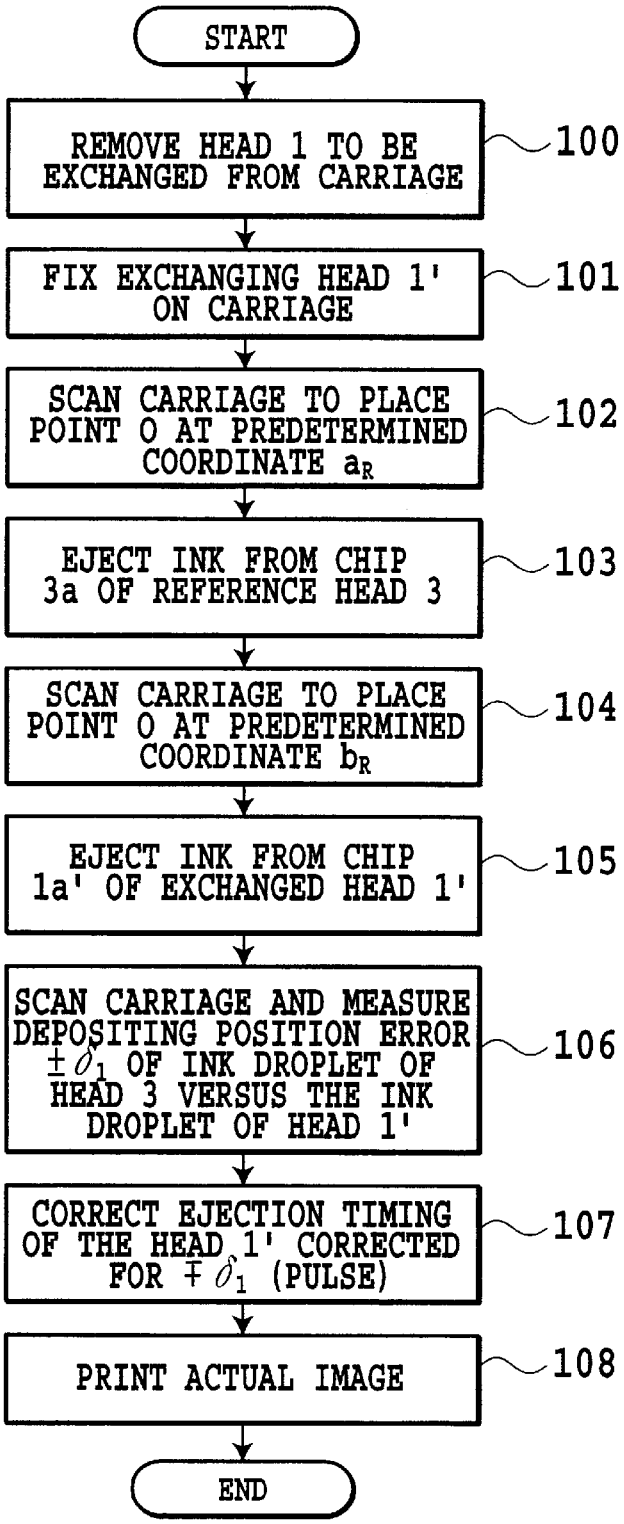
FIG. 4 is a flowchart showing the first embodiment of a registration adjusting method according to the present invention.
Figure 5:
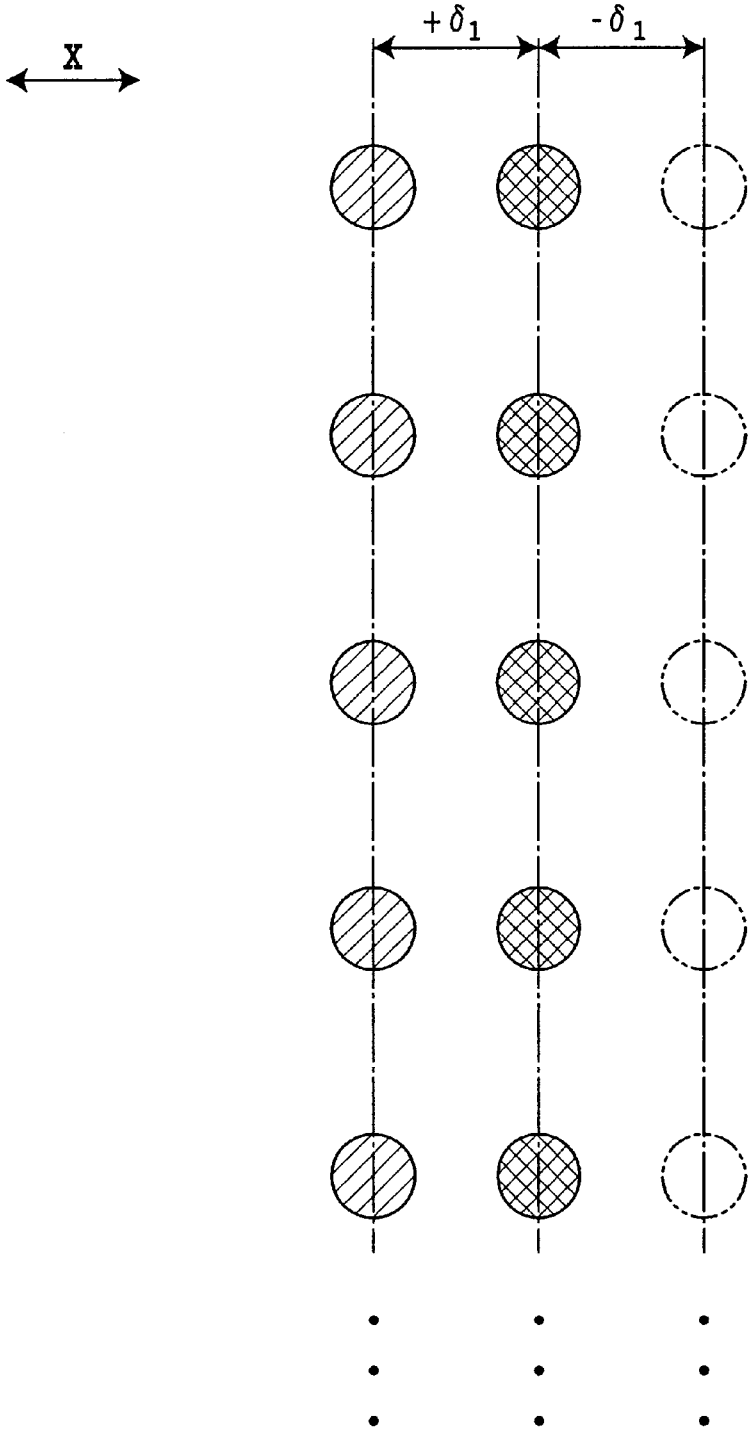
FIG. 5 is an illustration showing error in ink depositing position.

With reference to FIGS. 4 and 5 in addition to FIGS. 1 to 3, the first embodiment of the present invention will be described. The first embodiment shows procedure for the case where the printing head other than the reference head is exchanged.

The first embodiment is for reducing lowering of image quality due to tolerance in manufacturing of the linear encoder scale 7. In order to realize this, among a plurality of printing heads 1 to 4 arranged along a primary scanning direction, the printing head 3 (or the printing head 2), located closest to the center in the primary scanning direction, is taken as a reference head for registration adjustment. On the other hand, in the shown embodiment, three chips are provided for each printing head. The chip 3*a* of the reference head 3 is taken as a reference chip for registration adjustment. As a reference, the chip located closest to the center position among a plurality of chips is designated. It is desirable to take a position of the array of a plurality of ejection openings (ink ejection elements) arranged in alignment as the reference position of the reference chip.

Hereinafter, procedure of registration adjustment in the case where the printing head 1 is to be exchanged, will be described with reference to the flowchart shown in FIG. 4.

At first, the non-reference printing head 1 before exchanging is removed from the carriage 5 and the non-reference printing head 1' after exchanging is mounted at the predetermined position on the carriage 5 (steps 100 and 101). Namely, the printing head 1' after exchanging is fixed by abutting the head 1 to the positioning members 30 and 31.

Next, the carriage 5 is moved. When the encoder sensor 8 (point O) reaches a predetermined point $a_R$ on the linear encoder scale 7, ink is ejected from the chip 3*a* of the reference head 3 (steps 102 and 103). Here, upon ink ejection, the ink can be ejected at the true position $a_R$ not including tolerance in manufacturing of the linear encoder scale 7 by adjusting the ejection timing according to the adjusting value stored in the conversion table in the ejection timing control portion 9. Namely, in the conversion table, in connection with the point $a_R$, values corresponding to an error between the point $a_R'$ actually indicated on the linear encoder scale 7 (including tolerance in manufacturing) and the true position $a_R$, are stored.

Next, according to the encoder pulse signal output from the encoder sensor 8, after moving the carriage 5 in X direction for two nominal distances 2×D as a distance between the chip 3*a* of the reference head 3 and the chip 1*a'* of the exchanged head 1', ink is ejected from the chip 1*a'* of the exchanged head 1' (steps 104 and 105).

At this time, assuming that a point where the encoder sensor 8 is located after movement of the carriage 5 is point $b_R$, ink can be ejected to the true position $b_R$ not containing tolerance in manufacturing of the linear scale encoder 7 by adjusting the ejection timing of the ink using the conversion table similarly to the above. Namely, in the conversion table in the ejection timing control portion 9, even in relation to the point $b_R$, a value corresponding to the error between the point $b_R'$ actually indicated by the linear encoder scale 7 (containing tolerance in manufacturing) and the true position $b_R$ is stored.

FIG. 5 shows a string of ink droplets (shown by cross-hatching) ejected from the chip 3*a* of the reference head 3 when the encoder sensor 8 (point O) reaches the point $a_R$, and a string of ink droplets (shown by hatching) ejected from the chip 1*a'* of the exchanged head 1' when the encoder sensor 8 (point O) reaches the point $b_R$. In this case, a relative deposition error of the ink droplet strings becomes ±δ1 (converted value in the encoder pulse signal).

At step 106, the carriage 5 is scanned. By performing necessary signal processing after reading the foregoing two ink droplet strings by the registration sensor 6, offset of the depositing positions of both ink droplet strings is recognized as the number of pulses ±δ1 corresponding to the encoder pulse signal.

The ejection timing control portion 9 stores the registration adjusting value ±δ1 thus derived as a registration adjusting value of the exchanged printing head 1'. The ejection timing value of the printing head 1' set is then corrected on the basis of the registration adjusting value (step 107).

Upon actual printing, respective printing heads are driven using the ejection timing corrected as set forth above (step 108).

Even for other non-reference printing heads 2 and 4, registration adjustment similar to the above is performed.

Here, if inks are ejected from respective printing heads 1 to 4 simultaneously when the encoder sensor 8 reaches at an arbitrary point $c_R'$ on the linear encoder scale 7, the depositing positions of the ink droplets ejected from respective printing heads 1 to 4 are expressed as follows with taking nominal dimension between each printing head being D (the nominal dimension is recognized as being corresponding to the number of pulses Dp in the ejection timing control portion 9), a resolution of the linear encoder 7 being Δ, a distance between the reference chip 3*a* and the encoder sensor 8 being L, an error thereof being $L_0$, the point $c_R'$, the true position to be indicated by the points $c_R'$ being $c_R$, and offset amount between the point $c_R'$ and the true point $c_R$ being $c_G$:

Non-reference Head 1; $c_R \pm c_G + L \pm L_0 + 2Dp \cdot \Delta$

Non-reference Head 2; $c_R \pm c_G + L \pm L_0 + 2Dp \cdot \Delta$

Reference Head 3; $c_R \pm c_G + L \pm L_0$

Non-reference Head 4; $c_R \pm c_G + L \pm L_0 - Dp \cdot \Delta$

The relative depositing positions of the ink droplets of non-reference heads 1, 2 and 4, with taking the depositing positions of the ink droplets of the reference head 3 as a reference, are expressed by differences relative to the depositing position of the ink droplet of the reference head 3 as follows:

Non-reference Head 1; $+2Dp \cdot \Delta$

Non-reference Head 2; $+Dp \cdot \Delta$

Non-reference Head 4; $-Dp \cdot \Delta$ (2)

With the shown embodiment, since the printing head 3 located close to the center position among a plurality of printing heads is taken as the reference printing head for registration adjustment, the distances between the non-reference printing heads 1, 2 and 4 and the reference head 3 are averaged, resulting in eliminating a printing head having a particularly large distance to the reference head in comparison with other non-reference printing heads. Namely, in the preliminary study, the maximum distance between the non-reference printing heads and the reference head is 3Dp×Δ, while the shown embodiment can reduce the maximum distance to 2Dp×Δ. Accordingly, by the shown embodiment, an error in registration adjustment due to tolerance in manufacturing of the linear encoder scale can be further reduced.

[Second Embodiment]

Figure 6:
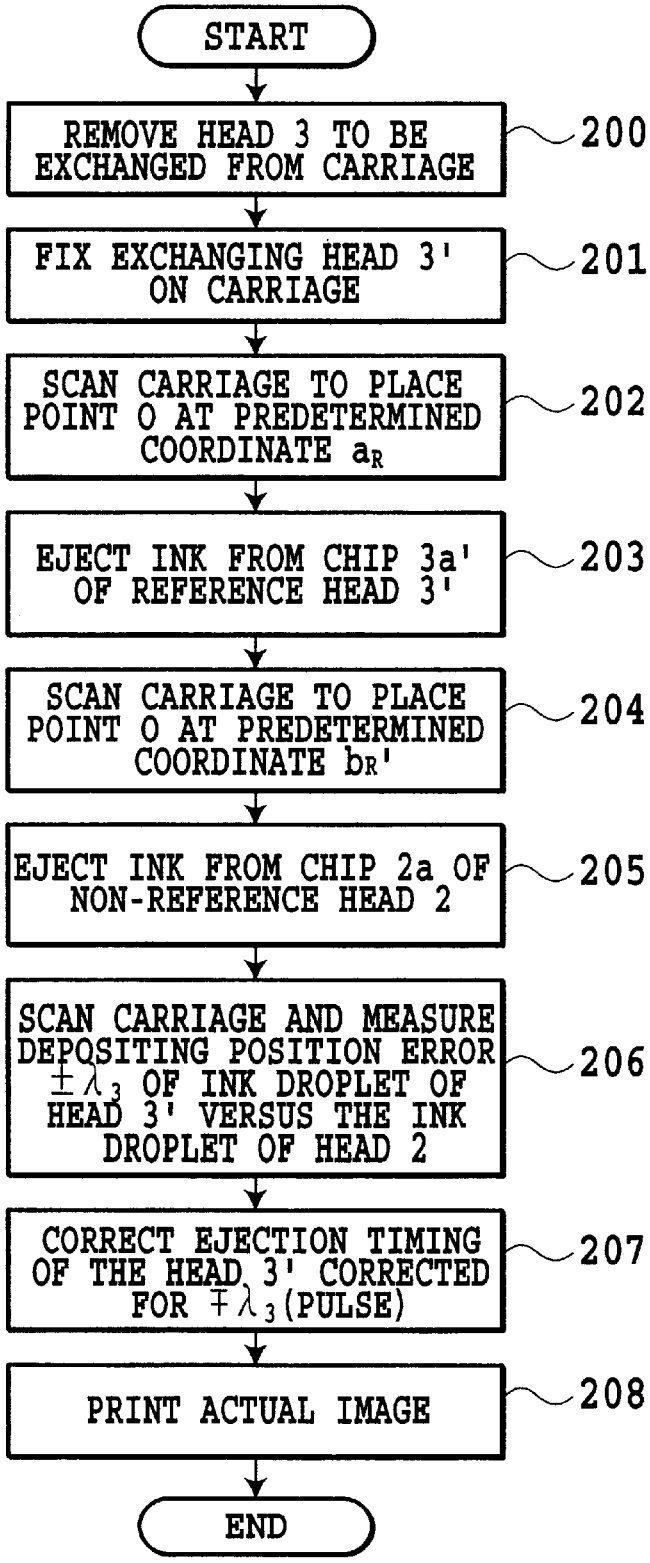
FIG. 6 is a flowchart showing the second embodiment of a registration adjusting method according to the present invention.

Next, description will be given for the second embodiment of the present invention with reference to FIGS. 6 and 7. The second embodiment will be described in terms of procedure in the case where the reference head 3 is exchanged.

Even in the second embodiment, the printing head 3 located close to the center among a plurality of printing heads 1 to 4 is taken as the reference head for registration adjustment. The chip 3*a* of the reference head 3 is taken as the reference chip for registration adjustment.

Hereinafter, procedure of registration adjustment in the case where the reference printing head 3 is to be exchanged, will be described with reference to the flowchart shown in FIG. 6.

At first, the reference printing head 3 before exchanging is removed from the carriage 5 and the reference printing head 3' after exchanging is mounted at the predetermined position on the carriage 5 (steps 200 and 201).

Next, the carriage 5 is moved. When the encoder sensor 8 (point O) reaches a predetermined point $a_R$ on the linear encoder scale 7, the ink is ejected from the chip 3*a*' of the reference head 3' (steps 202 and 203).

Next, according to the encoder pulse signal output from the encoder sensor 8, the carriage 5 is moved in X direction for a nominal distance D as a distance between the chip 3*a*' of the exchanged reference head 3' and the chip 2*a* of the non-reference head 2. Under a condition where the encoder sensor 8 (point O) is located at the predetermined point $b_R$ on the linear encoder scale 7, ink is ejected from the chip 2*a* of the non-reference printing head 2 (steps 204 and 205).

Figure 7:
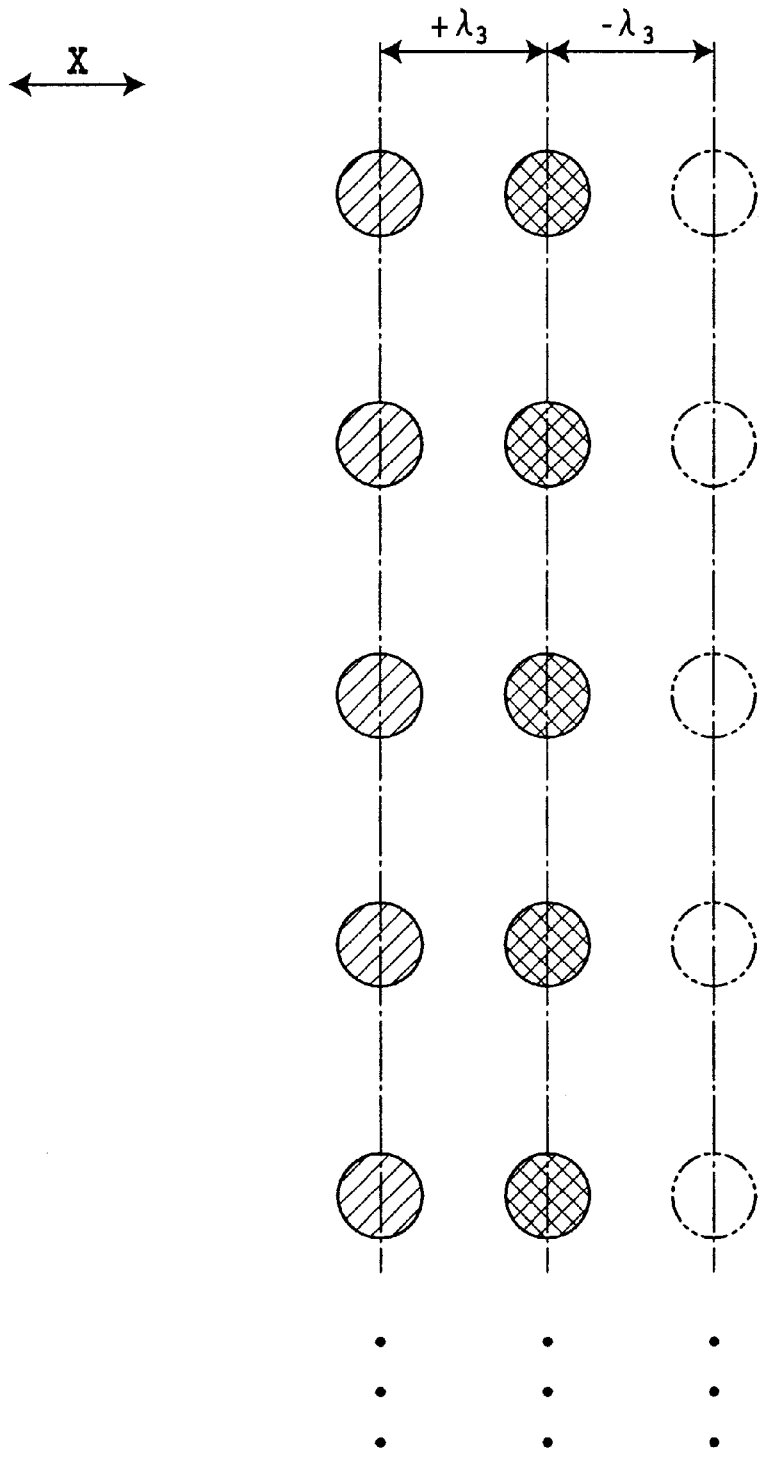
FIG. 7 is an illustration showing error in ink depositing position.

FIG. 7 shows a string of ink droplets (shown by cross-hatching) ejected from the chip 3*a*' of the reference head 3' when the encoder sensor 8 (point O) reaches the point $a_R$, and a string of ink droplets (shown by hatching) ejected from the chip 2*a* of the non-reference head 2 when the encoder sensor 8 (point O) reaches the point $b_R$. In this case, a relative deposition error of the ink droplet strings becomes $\pm\lambda_3$ (converted value in the encoder pulse signal).

At step 206, the carriage 5 is scanned. By performing necessary signal processing after reading the foregoing two ink droplet strings, offset of the depositing positions of both ink droplet strings is recognized as the number of pulses $\pm\lambda_3$ corresponding to the encoder pulse signal.

The ejection timing control portion 9 stores the registration adjusting value $\pm\lambda_3$ thus derived as the registration adjusting value of the exchanged reference printing head 3' and the ejection timing value of the printing head 3' set is corrected on the basis of the registration adjusting value (step 207).

Upon actual printing, respective printing heads are driven using the ejection timing corrected as set forth above (step 208).

In this embodiment, upon exchanging the reference head, adjustment of registration of the exchanged reference head is performed by using the registration adjustment amount data between the non-reference printing head and the exchanged reference printing head. Therefore, the registration adjustment process upon exchanging the reference head can be made efficient to shorten a period required for registration adjustment.

It should be noted that in the shown embodiment, registration adjustment of the reference printing head 3 is performed on the basis of the non-reference printing head 2, the registration adjustment of the reference head 3 can be performed on the basis of other non-reference printing head 1 or 4.

Also, by repeatedly performing registration adjustment upon exchanging the reference head in the foregoing procedure, errors relative to the registration reference may be accumulated to lower accuracy in adjustment of registration. Therefore, registration adjustment may be performed for all non-reference printing heads with reference to the printing head located close to the center taken as the reference printing head.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof are disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to generate thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated into the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consist of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through-holes formed in a porous sheet as liquid or solid substances so that the ink faces the electrothermal transducers as described in Japanese Patent Application Laying-open Nos. 54-56847 (1979) or 60-71260 (1985). The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

As set forth above, with the present invention, since the printing head located close to the center among a plurality of the printing heads is taken as the reference printing head for registration adjustment, errors in adjustment of registration due to tolerance in manufacturing of the linear encoder scale can be reduced and whereby lowering of the image quality can be reduced.

On the other hand, since the registration adjustment of the exchanged reference head is performed using the registration adjusting amount data of the non-reference printing head and the exchanged reference printing head upon exchanging of the reference printing head, the registration adjusting process upon exchanging the reference printing head is made efficient to shorten a period required for registration adjustment.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A registration adjustment method for an ink-jet printing apparatus, in which one of a plurality of printing heads arranged along a primary scanning direction is designated as a reference printing head, said method comprising the steps of:

measuring a relative positional relationship between an ink droplet ejected on a printing medium from the reference printing head and an ink droplet ejected on the printing medium from a non-reference printing head by converting a number of encoder pulse signals; and performing registration adjustment for the non-reference printing head by correcting an ink ejection timing of the non-reference printing head relative to the reference printing head with the encoder pulse signals on the basis of a result of said measuring step, wherein said step of performing the registration adjustment for the nonreference printing head relative to the reference printing head is effected by designating a printing head located closest to a center position among the plurality of printing heads as the reference printing head.

2. A registration adjustment method in an ink-jet printing apparatus as claimed in claim 1, wherein, in exchanging a non-reference printing head, said method comprises the steps of:

exchanging a non-reference printing head on a carriage, for which exchanging is required;

ejecting ink on the printing medium from the reference printing head under a condition where the carriage is scanned to a predetermined first position;

ejecting ink on the printing medium from the exchanged non-reference printing head under a condition where the carriage is scanned to a predetermined second position from the predetermined first position for a distance corresponding to a distance between the reference printing head and the exchanged non-reference printing head;

measuring a depositing position error between two strings of ink ejected on the printing medium; and correcting the ejection timing of the exchanged non-reference printing head on the basis of the measured depositing position error so that the two strings of ink match in the primary scanning direction.

3. A registration adjustment method in an ink-jet printing apparatus as claimed in claim 1, wherein, in exchanging the reference printing head, said method comprises the steps of:

exchanging the reference printing head on a carriage;

ejecting ink on the printing medium from the reference printing head under a condition where the carriage is scanned to a predetermined first position;

ejecting ink on the printing medium from a predetermined non-reference printing head under a condition where the carriage is scanned to a second position from the predetermined first position for a distance corresponding to a distance between the reference printing head and the predetermined non-reference printing head;

measuring a depositing position error between two strings of ink ejected on the printing medium; and correcting the ejection timing of the reference printing head on the basis of the measured depositing position error so that the two strings of ink match in the primary scanning direction.

4. A registration adjustment method in an inkjet printing apparatus as claimed in claim 1, wherein the reference printing head includes a plurality of chips, each provided with a plurality of ink ejecting elements for ejecting ink, and among the plurality of chips, the chip located at a position closest to the center position is designated as a reference.

5. A registration adjustment method in an ink-jet printing apparatus as claimed in claim 4, wherein ink ejection openings are arranged corresponding to the ejection elements in each of the plurality of the chips.

6. A registration adjustment method in an ink-jet printing apparatus as claimed in claim 5, wherein the reference is a string in the designated chip, in which a plurality of the ejection openings are aligned.

7. A registration adjusting method for an ink-jet printing apparatus, in which one of a plurality of printing heads arranged along a primary scanning direction is designated as a reference printing head, a relative positional relationship between an ink droplet ejected on a printing medium from the reference printing head and an ink droplet ejected on the printing medium from a non-reference printing head is measured by converting a number of encoder pulse signals, and registration adjustment for the non-reference printing head is performed by correcting an ink ejection timing of the non-reference printing head relative to the reference printing head with the encoder pulse signals on the basis of a result of measurement, wherein, in exchanging the reference printing head, said method comprises the steps of:

exchanging the reference printing head on a carriage;

ejecting ink on the printing medium from the reference printing head under a condition where the carriage is scanned to a predetermined first position;

ejecting ink on the printing medium from a predetermined non-reference printing head under a condition where the carriage is scanned to a second position from the predetermined first position for a distance corresponding to a distance between the reference printing head and the predetermined non-reference printing head;

measuring a depositing position error between two strings of ink ejected on the printing medium; and correcting the ejection timing of the reference printing head on the basis of the measured depositing position error so that the two strings of ink match in the primary scanning direction.

8. A registration adjustment method in an ink-jet printing apparatus as claimed in claim 7, wherein the reference printing head includes a plurality of chips, each provided with a plurality of ink ejecting elements for ejecting ink, and among the plurality of chips, the chip located at a position closest to the center position is designated as a reference.

9. A registration adjustment method in an ink-jet printing apparatus as claimed in claim 8, wherein ink ejection openings are arranged corresponding to the ejection elements in each of the plurality of chips.

10. A registration adjustment method in an ink-jet printing apparatus as claimed in claim 9, wherein the reference is a string in the designated chip, in which a plurality of ejection openings are aligned.

* * * * *

UNITED STATES PATENT AND TRADEMARK OFFICE

CERTIFICATE OF CORRECTION

PATENT NO. : 6,464,323 B2
DATED : October 15, 2002
INVENTOR(S) : Yokoyama et al.

It is certified that error appears in the above-identified patent and that said Letters Patent is hereby corrected as shown below:

Column 2,
Line 10, “nonreference” should read -- non-reference --.

Column 4,
Line 56, “aR” should read -- $a_R$ --.

Column 8,
Line 6, “head 1” should read -- head 1' --.

Column 13,
Line 11, “nonreference” should read -- non-reference --; and
Line 59, “inkjet” should read -- ink-jet --.

Signed and Sealed this

Twenty-second Day of July, 2003

JAMES E. ROGAN
*Director of the United States Patent and Trademark Office*